US010704272B1

(12) United States Patent
Gaylord

(10) Patent No.: US 10,704,272 B1
(45) Date of Patent: Jul. 7, 2020

(54) TILE BACKSPLASH MANUFACTURE METHOD

(71) Applicant: Leah Gaylord, Grand Junction, CO (US)

(72) Inventor: Leah Gaylord, Grand Junction, CO (US)

( * ) Notice: Subject to any disclaimer, the term of this patent is extended or adjusted under 35 U.S.C. 154(b) by 0 days.

(21) Appl. No.: 16/538,222

(22) Filed: Aug. 12, 2019

Related U.S. Application Data

(60) Provisional application No. 62/718,425, filed on Aug. 14, 2018.

(51) Int. Cl.

| | |
|---|---|
| ***E04F 21/02*** | (2006.01) |
| ***E04F 13/08*** | (2006.01) |
| ***E04F 13/10*** | (2006.01) |
| ***E04F 13/14*** | (2006.01) |
| ***E04F 13/12*** | (2006.01) |

(52) U.S. Cl.
CPC ..... *E04F 21/023* (2013.01); *E04F 13/0871* (2013.01); *E04F 13/0885* (2013.01); *E04F 13/10* (2013.01); *E04F 13/12* (2013.01); *E04F 13/144* (2013.01)

(58) Field of Classification Search
CPC . E04F 13/0885; E04F 13/0871; E04F 13/147; E04F 21/023; B28B 19/0053
See application file for complete search history.

(56) References Cited

U.S. PATENT DOCUMENTS

| | | | | |
|---|---|---|---|---|
| 1,923,843 | A * | 8/1933 | Premo | B28B 19/0053 156/63 |
| 2,266,510 | A * | 12/1941 | Pottinger | B28B 19/0053 264/276 |
| 2,907,129 | A * | 10/1959 | Bedell | B28B 11/04 118/35 |
| 4,713,032 | A * | 12/1987 | Frank | B63B 32/50 441/74 |
| 4,894,272 | A * | 1/1990 | Aisley | B29C 39/026 428/119 |
| 8,501,069 | B1 * | 8/2013 | Williamson | B29C 37/0032 264/259 |
| 8,898,908 | B2 * | 12/2014 | Tiirola | E04F 13/147 29/897.34 |
| 9,114,422 | B1 * | 8/2015 | Toma | B29C 39/003 |
| 10,334,993 | B1 * | 7/2019 | Nastasi | A47K 3/40 |
| 2002/0100241 | A1 * | 8/2002 | Rygiel | B28B 7/0073 52/561 |
| 2007/0101677 | A1 * | 5/2007 | Brailsford | B32B 37/12 52/747.11 |

FOREIGN PATENT DOCUMENTS

| | | | | |
|---|---|---|---|---|
| FR | 2845402 | A1 * | 4/2004 | B28B 19/0053 |

* cited by examiner

*Primary Examiner* — Christine T Cajilig
(74) *Attorney, Agent, or Firm* — Luis Figarella

(57) ABSTRACT

Method of manufacture for panels usable as Tile backsplashes in showers or kitchen areas, to provide the surface with a desired appearance, durability, as well as water and air resistance. The proposed product of the method creates a "belly splash" panel specifically formed from a composite of epoxy and glass.

2 Claims, 5 Drawing Sheets

TILE BACKSPLASH MANUFACTURE METHOD

CROSS-REFERENCE TO RELATED APPLICATIONS

This application claims priority to U.S. Provisional patent application Ser. No. 62/718,425 titled "Tile Backsplash Manufacture Method", filed on Aug. 14, 2019 the disclosure of which is herein incorporated by reference in its entirety.

PATENTS CITED

The following documents and references are incorporated by reference in their entirety, Bolin (U.S. Pat. Nos. 8,353,144; 9,303,403 and 9,739,066), Davis (U.S. Pat. No. 5,419,264) and Taylor Jr., et al (U.S. Pat. No. 9,963,885).

FIELD OF THE INVENTION

The present invention relates to a method for manufacture of a tile back splash panel, and specifically to the method used in making a composite epoxy glass "belly splash" panel.

DESCRIPTION OF THE RELATED ART

Ceramic tile, and tile mosaics are very popular ways to provide relief and cosmetic enhancements to walls, in particular to areas that may become wet, such as bath and kitchen walls. Laying tile can be a long process, prone to many failures, both in layout and in maintenance. Grouting is well understood, but can be very prone to staining when placed around such wet areas in showers or near cooking surfaces. In particular, they require application by experts, which translates to higher installation costs.

Recently, it has become very popular to have 'belly splash' panels (aka backsplash surfaces), intended for mid-height cosmetic decoration. Many attempts have been made to produce specific surfaces, but they have the shortcomings of requiring vacuum and/or other sophisticated mfg. methods. What is needed, is an easy to mfr. backsplash surface that can be manufactured easily, is safe to handle and provides a durable surface.

SUMMARY OF THE INVENTION

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

In one aspect, the invention is about a method for manufacturing a Tile Backsplash panel, the method comprising the steps of: providing a large flat slab, then cleaning and polishing said slab's surface, forming one or more fluid containment pools, each said pool having said slab's surface as a bottom, and four or more continuous berms along the periphery of said pool, placing one or more blocks within one or more of said pools, flattening one or more of said blocks against the slab by pressing a flattening tool against the back of one or more of said blocks, preparing a hardening mixture, pouring said hardening mixture into one or more of said containment pools until the level of said mixture reaches the level of said berms tops, before the mixture completely hardens, passing a flat tool so as to flatten the top of the said hardening mixture and once said hardening mixture hardens, removing said berms. In another aspect said hardening mixture is comprised of: 37% block inlay, 43% marble, 10% resin, 8% gelcoat and 2% catalyst, where the percentages in the block inlay, marble and/or gelcoat are varied by as much as 25% respectively. In yet another aspect, said slab is made of a reasonably flat surface made of one or more of the following materials: marble, granite, metal, plastic or any other composite that will not chemically interact with the hardening mixture, said berms are made of one or more of the following materials: metal, wood, granite, marble, plastic, composite or any other suitable material capable of preventing the hardening mixture from escaping said pool, as well as of not chemically interacting with said hardening mixture.

Other features and advantages of the present invention will become apparent upon examining the following detailed description of an embodiment thereof, taken in conjunction with the attached drawings.

Figure 1:
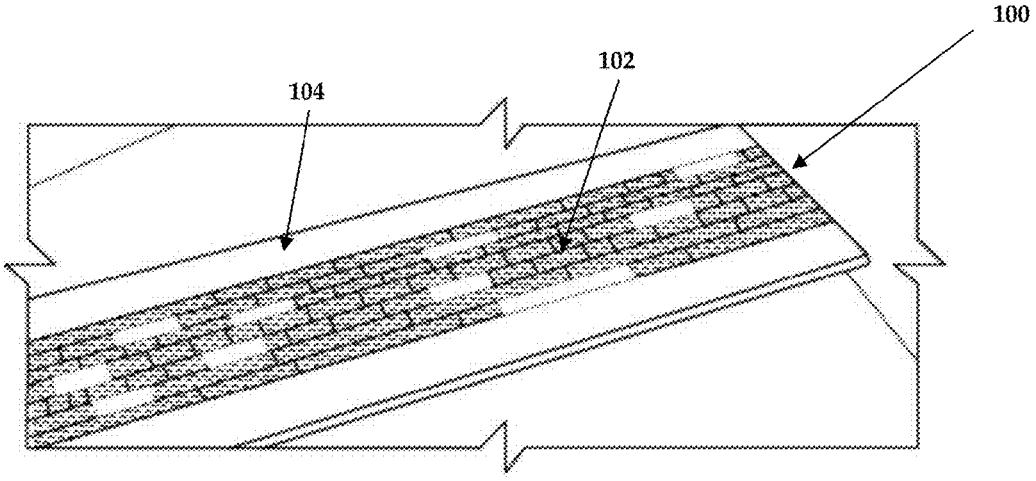
FIG. 1 shows an illustration of a finished tile backsplash panel, according to an exemplary embodiment of the invention.

The above-described and other features will be appreciated and understood by those skilled in the art from the following detailed description, drawings, and appended claims.

DETAILED DESCRIPTION OF THE PREFERRED EMBODIMENT

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

To provide an overall understanding of the invention, certain illustrative embodiments and examples will now be described. However, it will be understood by one of ordinary skill in the art that the same or equivalent functions and sequences may be accomplished by different embodiments that are also intended to be encompassed within the spirit and scope of the disclosure. The compositions, apparatuses, systems and/or methods described herein may be adapted and modified as is appropriate for the application being addressed and that those described herein may be employed in other suitable applications, and that such other additions and modifications will not depart from the scope hereof.

Simplifications or omissions may be made to avoid obscuring the purpose of the section. Such simplifications or omissions are not intended to limit the scope of the present invention. All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art.

As used in the specification and claims, the singular forms "a", "an" and "the" include plural references unless the context clearly dictates otherwise. For example, the term "a transaction" may include a plurality of transaction unless the context clearly dictates otherwise. As used in the specification and claims, singular names or types referenced include variations within the family of said name unless the context clearly dictates otherwise.

Certain terminology is used in the following description for convenience only and is not limiting. The words "lower," "upper," "bottom," "top," "front," "back," "left," "right" and "sides" designate directions in the drawings to which reference is made, but are not limiting with respect to the orientation in which the modules or any assembly of them may be used.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

Figure 8:
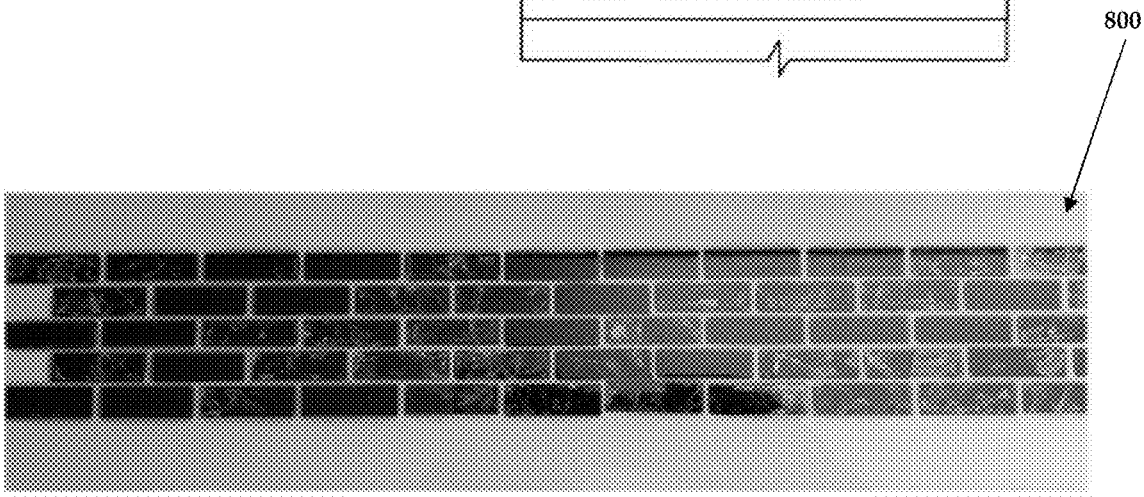
FIG. 8 shows an illustration of a finished tile backsplash panel, according to an exemplary embodiment of the invention.

Referring to FIGS. 1 and 8 we see the product of the proposed method, a tile backsplash or composite epoxy glass "belly splash" panel 100 which may be cut to any size 800. This "belly splash" tile 100/800 may then be used along the wall of a shower/bath or as a backsplash in a kitchen or other area subject to be wetted.

The tile 100 is created from a composite of blocks 102 (made of glass or other similar material) surrounded by a hardened epoxy band 104 which together forms a composite structure suitable for mounting against a wall or other flat surface, in a fashion similar to tiles (i.e. by the typical chemical bonding process to the wall or moisture resistant drywall).

The tile 100 has several advantages over the traditional tiling process, with the principal one being that there is no need for grouting the blocks 102, aligning them, or in any other fashion spend any extra time in making a continuous line of individual blocks at the job site.

Figure 2:
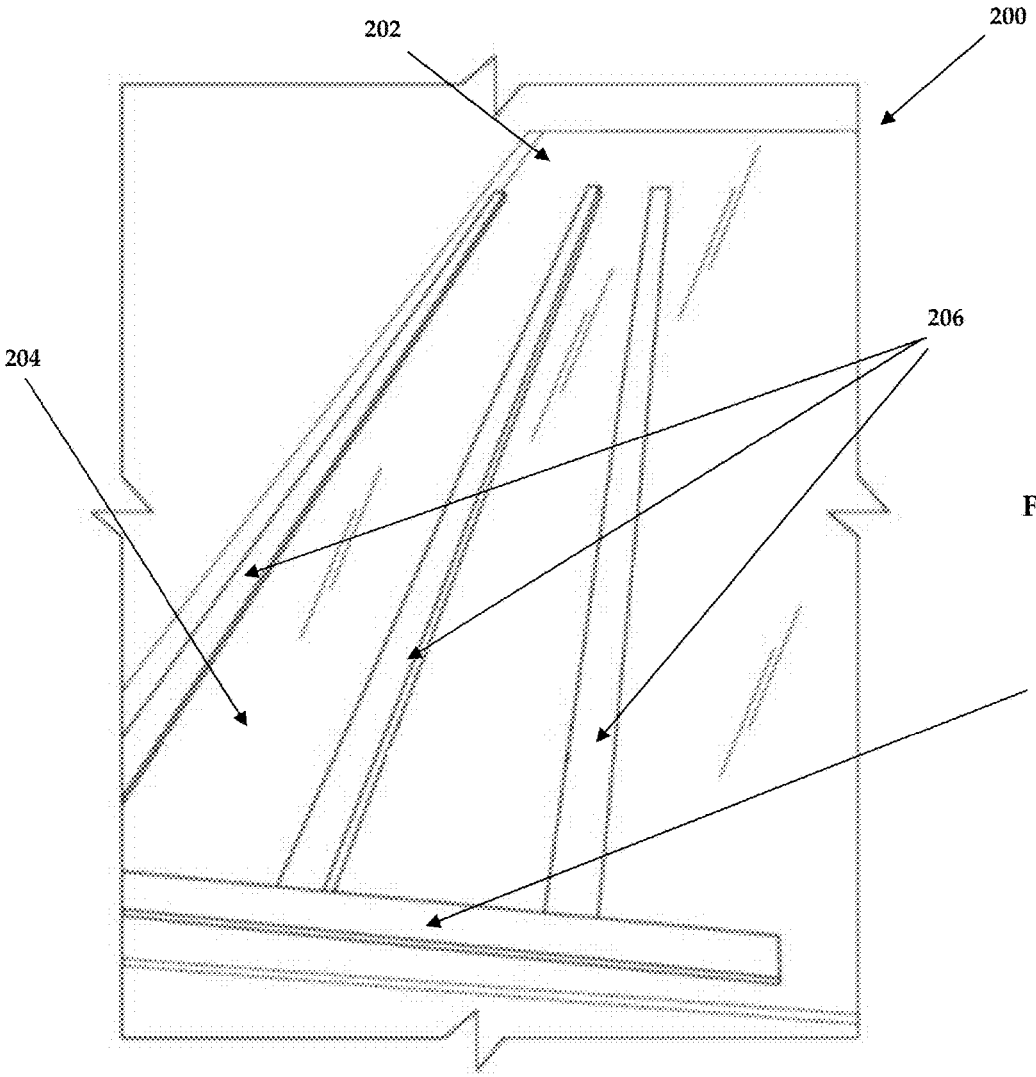
FIG. 2 shows an illustration of the epoxy pools formed above a polished slab, according to an exemplary embodiment of the invention.

The manufacturing process (FIG. 2) begins 200 by cleaning and polishing a slab 202, via either manual or powered means such as a buffing wheel. The slab 202 may be made of any reasonably flat surface, including marble, granite, metal, plastic or any other composite that will not interact with an epoxy or any other suitable hardening mixture. This allows for a clean, smooth and level work area.

Next, a series of fluid containment pools 204 are created by enclosing them within removable dams or berms 206/208 (preferably laid by horizontal 206 and vertical 208 members), creating enclosed pools suitable of holding the hardening mixture. The berms 206 may be metal, wood, granite, marble, plastic, composite or any other suitable material capable of forming straight lines and being placed flat against the slab 202, so as to contain the mixture that will be poured within it without allowing it to escape along the berms or under them. In addition, as with the slab, care must be taken to ensure that the berm material does not interact with an epoxy or any other suitable hardening mixture.

In one embodiment, rectangular tiles 100 are formed by making sure the horizontal berm members 206 are significant parallel to each other and orthogonal to the vertical berm member 208. As may be clear to anyone skilled in the art, the shape of the tile need not be limited to rectangles, as any shape that may be formed by a combination of berms enclosing a pool 204 over the slab 202 (including circular, orthogonal, etc.) may be created.

Figure 3:
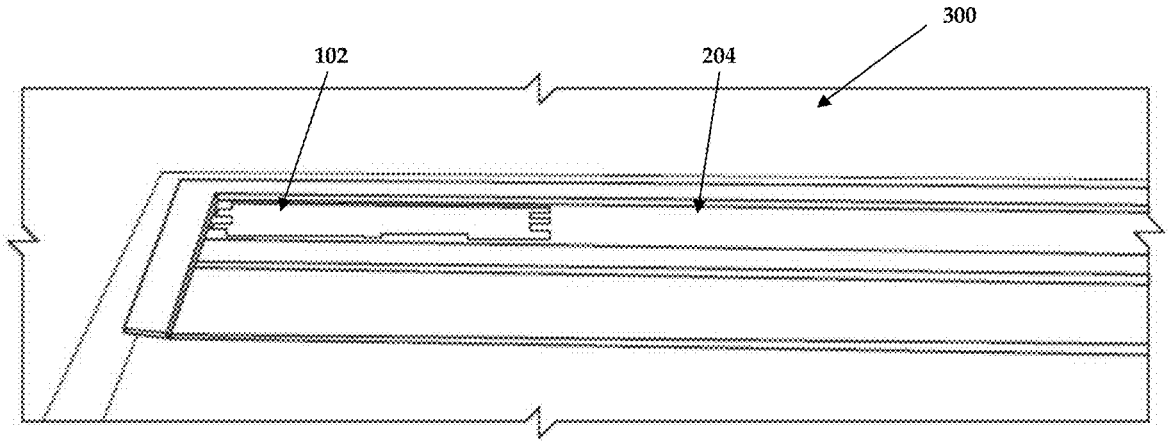
FIG. 3 shows a first composite block placed within one of the epoxy pools, according to an exemplary embodiment of the invention.

Next (FIG. 3), a sequence 300 of one or more blocks 102 are placed sequentially along the length of one of the pools 204. Note the blocks 102 may be comprised of one or more individual glass, ceramic or plastic tiles, pre-formed collections of tiles forming a pattern, distinct shapes (e.g. animals, letters, messages), battery powered Light Emitting Diodes (LED) lights, solar cells already connected to LED lights, etc.). The blocks 102 are placed with the understanding that the 'down' side (i.e. the fascia of the blocks 102 facing the slab) will be the 'front' or customer facing side. As noted before, a significant advantage of the method is that by placing the blocks 102 within the berms 206/206 it is easy to align/abut or otherwise optically correct the finished product geometry.

Figure 4:
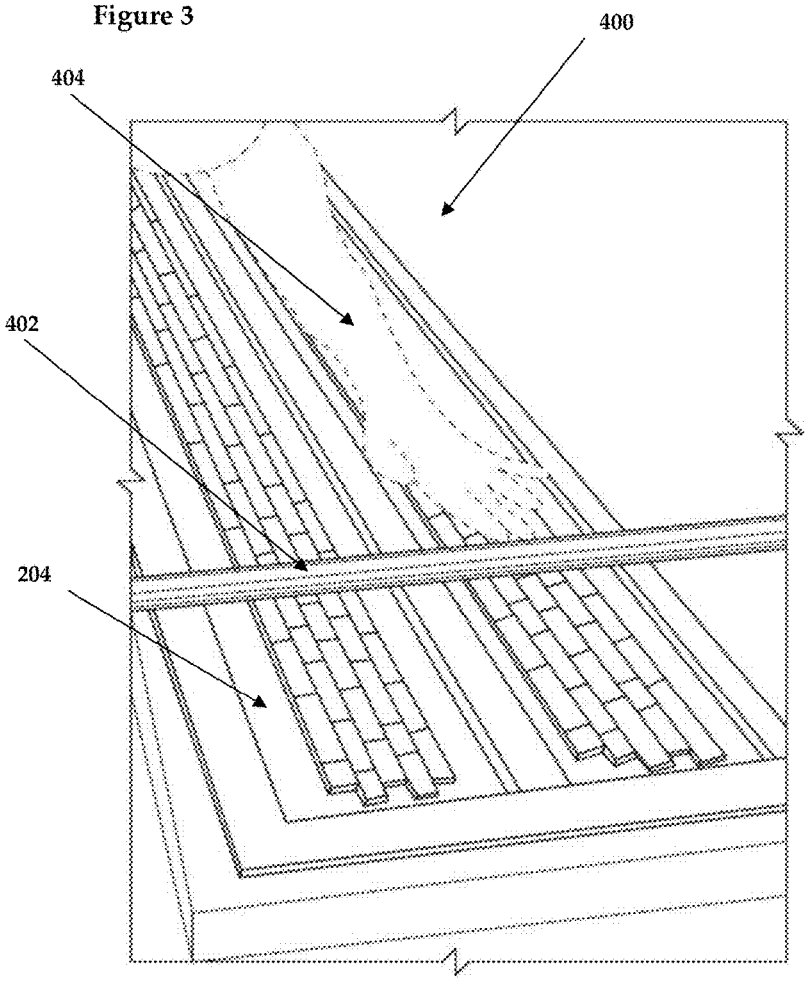
FIG. 4 shows an illustration of a rod or flattening tool being run along the length of a berm, according to an exemplary embodiment of the invention.

Once (FIG. 4) the block 102 are laid, to ensure quality 400, a rod or other flattening tool 402 is ran along the length of the berms 206 tops, ensuring said rod presses the back of said block 102, in order to press and ensure that the fascia of each block 102 lays flat against the slab 202. This process may be a manual one, where a human 404 does the above, as may be the placement. In another embodiment, any and all parts of the above may performed by a robot or other automated placement tool.

Figure 5:
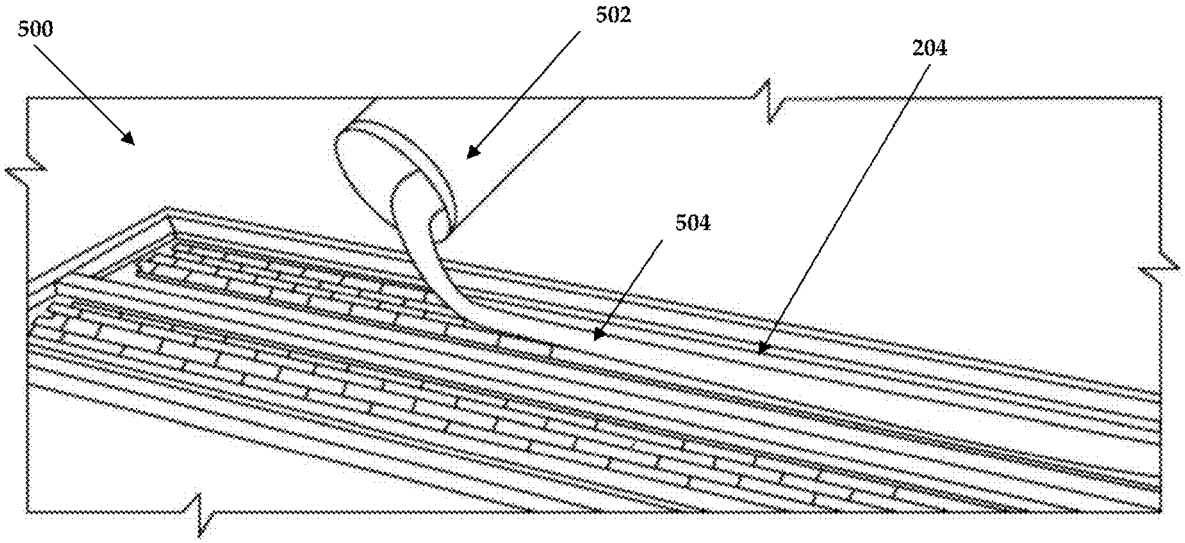
FIG. 5 shows an illustration of the mixture being poured into the berm, according to an exemplary embodiment of the invention.

Next (FIG. 5), the pools 204 are going to be filled (again, manually or automatically) by a hardening mixture 504, which in one embodiment is poured from a container 502. In one embodiment, the recipe for the hardening mixture composite is formed as proposed in Example 1 below.

EXAMPLE 1

37% block inlay, in one embodiment from a material similar to Daltile™.

43% marble, in one embodiment from a material similar to RJ Marshall Marfill 40™.

10% resin, in one embodiment from a material similar to Polylite™.

8% gelcoat, in one embodiment from a material similar to ProCast™ polyurethane resin.

2% catalyst, in one embodiment from a material similar to Norxmekp-900™ catalyst.

The percentages in the mixture above may be adjusted, particularly in the case of the block inlay/marble/gelcoat, by as much as 25% per.

The above is then mixed until smooth and as stated before, the mixture 504 poured 500 into each pool 204 so that the mixture 504 fills the pool 204 until the mixture level reaches the top edge of the berms 206/208.

Figure 6:
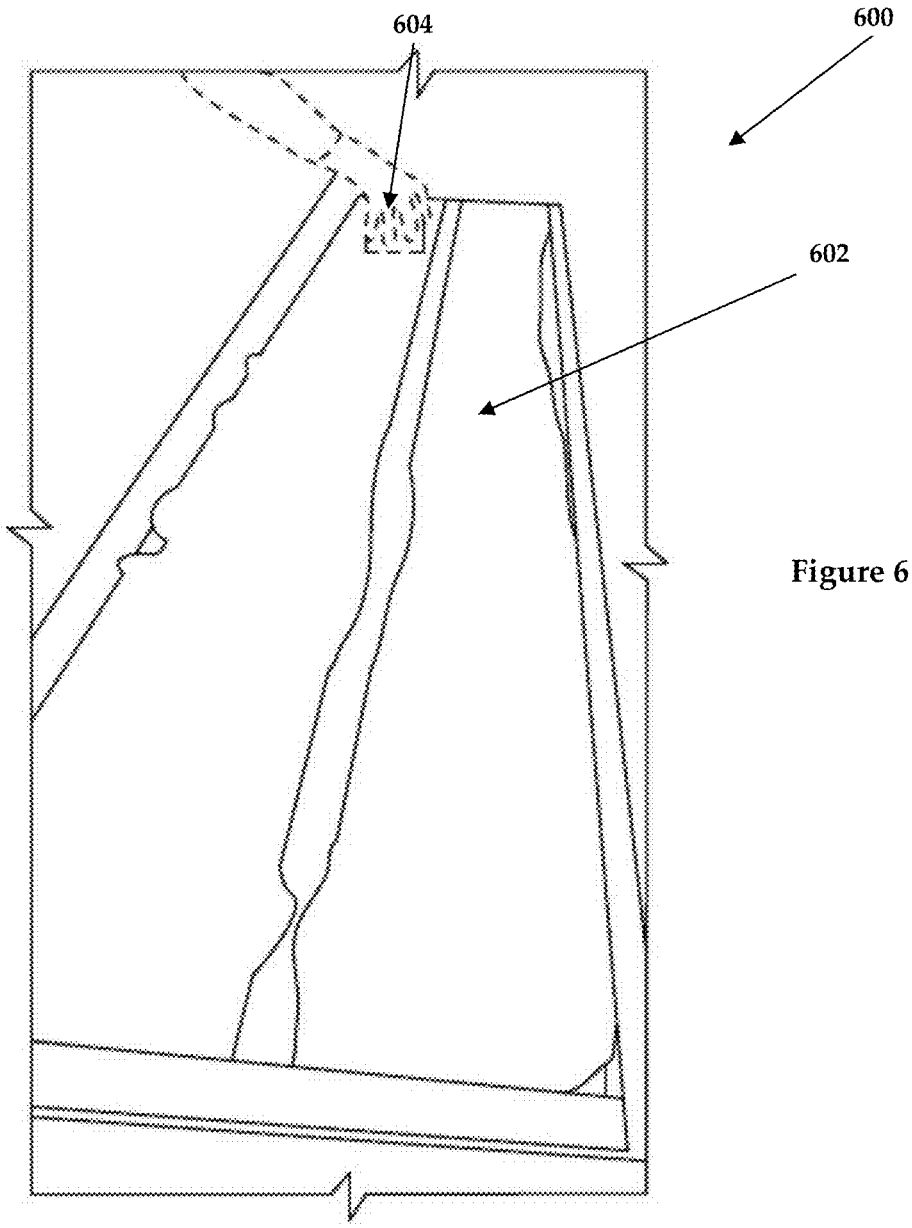
FIG. 6 shows an illustration of a the top of the mixture within the berm being smoothed, according to an exemplary embodiment of the invention.

As seen in FIG. 6 and before the mixture 504 completely hardens, the top of the mixture 602 is smoothed 604 by passing a flat tool (either manually or automatically), so that any excess reaching over the top of the berms 206/208 may be removed. This 'top' 602 will become the 'back' of the tile, so at this time any desired mechanical support may be added (such as a grid of semi-flexible material or even hanging hooks).

Figure 7:
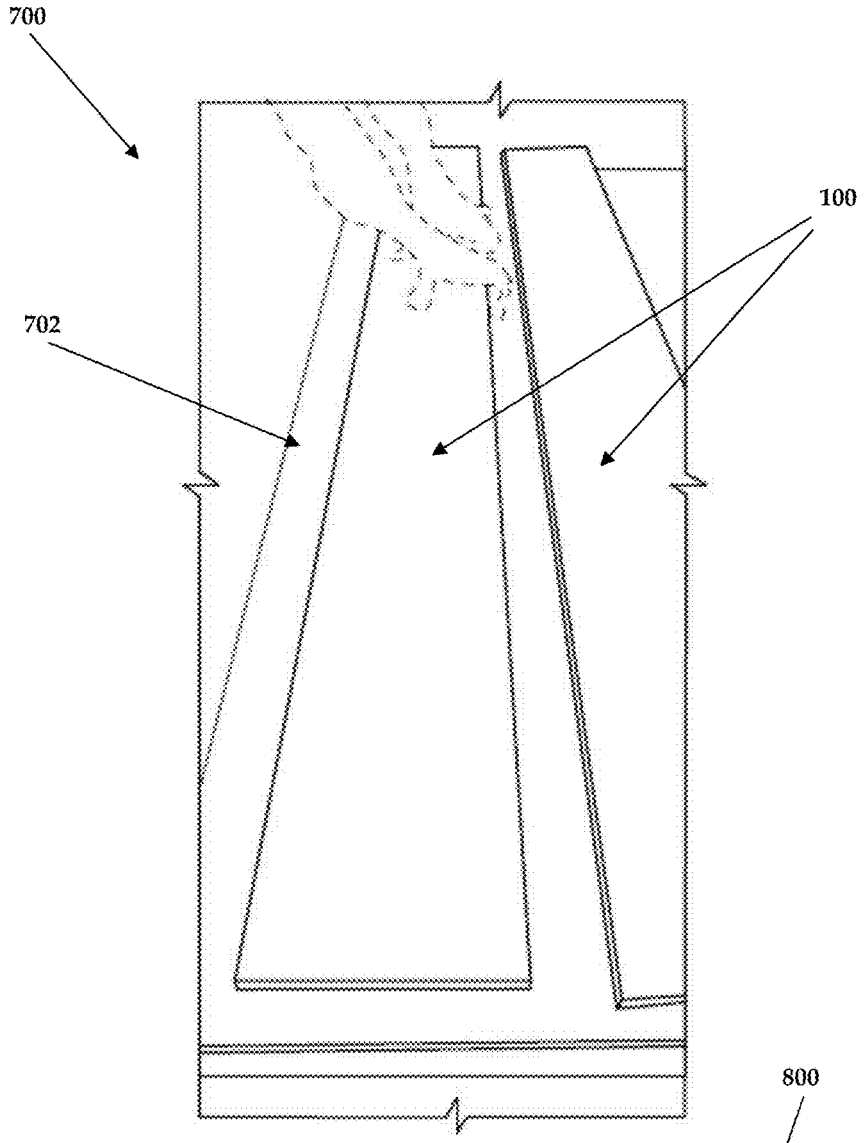
FIG. 7 shows an illustration of a finished tile backsplash panel once the berms of the pool are removed, according to an exemplary embodiment of the invention.

Once the mixture hardens 700 (FIG. 7), the berms (both horizontal and vertical 206/208) are removed, leaving one or more gaps 702 between the fully formed tile panel backstops or belly splash panels 100. Once 'flipped', the fascia facing the slab 202 becomes the front facing the customer. In one embodiment, the ends, edges and backs of each tile panel 100 are preferably sanded to create a smooth and clean mounting surfaces. In one embodiment (FIG. 8), the tile panels 100 may be cut in any desired length 800 (FIG. 8).

Note that in an alternate embodiment, not only are the blocks 102 forming laid end to end, but may also form a continuous wall (where the middle or center berms are omitted, forming a single, larger pool 204), so that a band of block and another of hardened mixture 504 for the complete wall structure.

CONCLUSION

In concluding the detailed description, it should be noted that it would be obvious to those skilled in the art that many variations and modifications can be made to the preferred embodiment without substantially departing from the principles of the present invention. Also, such variations and modifications are intended to be included herein within the scope of the present invention as set forth in the appended claims. Further, in the claims hereafter, the structures, materials, acts and equivalents of all means or step-plus function elements are intended to include any structure, materials or acts for performing their cited functions.

It should be emphasized that the above-described embodiments of the present invention, particularly any "preferred embodiments" are merely possible examples of the implementations, merely set forth for a clear understanding of the principles of the invention. Any variations and modifications may be made to the above-described embodiments of the invention without departing substantially from the spirit of the principles of the invention. All such modifications and variations are intended to be included herein within the scope of the disclosure and present invention and protected by the following claims.

The present invention has been described in sufficient detail with a certain degree of particularity. The utilities thereof are appreciated by those skilled in the art. It is understood to those skilled in the art that the present disclosure of embodiments has been made by way of examples only and that numerous changes in the arrangement and combination of parts may be resorted without departing from the spirit and scope of the invention as claimed. Accordingly, the scope of the present invention is defined by the appended claims rather than the foregoing description of embodiments.

The invention claimed is:

1. A method for manufacturing a Tile Backsplash panel, the method comprising the steps of:

providing a flat slab, then cleaning and polishing said slab's surface;

forming one or more fluid containment pools, each said pool having said slab's surface as a bottom, and four or more continuous berms along the periphery of said pool;

placing one or more blocks within one or more of said pools;

flattening one or more of said blocks against the slab by pressing a flattening tool against the back of one or more of said blocks;

preparing a hardening mixture wherein said hardening mixture is comprised of:

37% block inlay, 43% marble, 10% resin, 8% gelcoat and 2% catalyst, where the percentages in the block inlay, marble and/or gelcoat are varied by as much as 25% respectively;

pouring said hardening mixture into one or more of said containment pools until the level of said mixture reaches the level of said berms tops;

before the mixture completely hardens, passing a flat tool so as to flatten the top of the said hardening mixture;

once said hardening mixture hardens, removing said berms.

2. The method of claim 1, wherein;

said slab is made of a flat surface made of one or more of the following materials:

marble, granite, metal, plastic or any other composite that will not chemically interact with the hardening mixture;

said berms are made of one or more of the following materials:

metal, wood, granite, marble, plastic, composite or any other suitable material capable of preventing the hardening mixture from escaping said pool, as well as of not chemically interacting with said hardening mixture.

* * * * *